US005316401A

United States Patent [19]

Sears

[11] Patent Number: 5,316,401

[45] Date of Patent: May 31, 1994

[54] SCRUBBING ATTACHMENT FOR SPRAY NOZZLES

[75] Inventor: Thomas H. Sears, 121 GlenLea Dr., Glen Burnie, Md. 21060

[73] Assignees: Thomas H. Sears, Glen Burnie; Craig A. Mercier, Pasadena, both of Md.

[21] Appl. No.: 24,216

[22] Filed: Mar. 1, 1993

[51] Int. Cl.[5] ..... A47L 17/00

[52] U.S. Cl. ..... 401/139; 401/137; 401/203; 401/290

[58] Field of Search ..... 401/137, 139, 27, 42, 401/43, 46, 203, 204, 290

[56] References Cited

U.S. PATENT DOCUMENTS

| | | | |
|---|---|---|---|
| 843,585 | 2/1907 | Cole | 401/290 X |
| 1,410,711 | 3/1922 | Myers et al. | 401/203 X |
| 2,575,222 | 11/1951 | Isenberg . | |
| 2,590,353 | 3/1952 | Schaars et al. . | |
| 2,807,816 | 10/1957 | O'Brien | 401/15 |
| 3,131,868 | 5/1964 | Coleman . | |
| 3,453,059 | 7/1969 | Noble . | |
| 3,498,546 | 3/1970 | Logan et al. . | |
| 3,743,188 | 7/1973 | Wagner . | |
| 3,810,702 | 5/1974 | Bent | 401/139 |
| 4,126,401 | 11/1978 | Stoyshin . | |
| 4,311,404 | 1/1982 | Kodera . | |
| 4,761,839 | 8/1988 | Ganaway . | |
| 5,070,552 | 12/1991 | Gentry et al. . | |

*Primary Examiner*—Steven A. Bratlie
*Attorney, Agent, or Firm*—Richard C. Litman

[57] ABSTRACT

A scrubber attachment for spray nozzles or sprayer heads provides for the offset attachment of the scrubber portion from the spray nozzle. The attachment may be easily and quickly installed on existing spray nozzles in order to provide for mechanical scrubbing of dishes and other utensils, in addition to the water spray provided by the spray nozzle. As the scrubber portion is radially offset from and does not completely surround the outflow of the nozzle, the scrubber can be made of relatively dense, firm and semi-porous material in order to achieve better scrubbing action than would be attained by the standard concentric brush or sponge with which such spray nozzles are generally equipped.

16 Claims, 2 Drawing Sheets

SCRUBBING ATTACHMENT FOR SPRAY NOZZLES

FIELD OF THE INVENTION

The present invention relates generally to brushing, scrubbing and general cleaning, and more specifically to a scrubbing attachment which is installable on an existing spray nozzle or spray head for use in cleaning dishes and related utensils.

BACKGROUND OF THE INVENTION

Dishwashing is generally considered to be an onerous task. It can be especially difficult and tedious to clean dishes and related utensils thoroughly and completely, especially when burned, dried or other hardened residue has become stuck to the utensils. As a result, numerous devices have been developed to assist in the cleaning of dishes, silverware and related cooking utensils and articles, such as automatic dishwashers.

However, for various reasons (e.g., lack of space) many persons have installed a spray nozzle or spray head connected by means of a hose to an existing water supply at a kitchen sink, in order to ease the burden of dishwashing. While these devices provide some advantage over other manual dishwashing systems, they are still limited by the water system pressure and the maximum water temperature which can be withstood by the user of the device. As a result, it can be difficult to remove residue which is stuck to eating or cooking utensils when cleaning such utensils with such a sprayer.

Due to the above limitations, it has been found that a fair amount of additional mechanical scrubbing must often be used to remove hardened deposits which have stuck to the various utensils. Accordingly, many devices have been developed to provide this function in combination with a spray nozzle. However, most of these devices include a brush or scrubbing device as an inseparable part of the spray nozzle. Of those few scrubbing or brushing devices which are removable from the nozzle, all impede at least some of the water flowing from the nozzle and thus require a fair amount of porosity in order to allow for the flow of water therethrough. Accordingly, they must be relatively soft and pliable and are thus limited in their ability to remove hardened materials mechanically from utensils.

The need arises for a scrubbing device which is attachable to an existing spray nozzle or spray head, which provides sufficient mechanical strength to remove stuck deposits readily from cooking and eating utensils. The device must be attached in a manner which does not appreciably block any of the outflow from the nozzle in order to provide adequate flow during the washing operation.

DESCRIPTION OF THE PRIOR ART

U.S. Pat. No. 2,575,222 issued to Stanley Isenberg on Nov. 13, 1951 discloses a Faucet Spray Attachment. The device includes means for varying the spray pattern and amount, but no additional scrubbing device is included.

U.S. Pat. No. 2,590,353 issued to Charles H. Schaar et al. on Mar. 25, 1952 discloses a Washing Apparatus wherein the brush is permanently affixed to the nozzle outlet. The assembly is not readily attachable to an existing spray nozzle.

U.S. Pat. No. 3,131,868 issued to Josie B. Coleman on May 5, 1964 discloses a Flexible Nozzle Attachment for use in dishwashing. While a plurality of brush type attachments is disclosed, each includes a nozzle outlet and is specially adapted for attachment to the flexible nozzle as disclosed in the Coleman patent and is not readily adaptable to other devices. Moreover, the brush portions are concentrically disposed about the water outlet of the device, requiring a fair degree of porosity as would generally be provided by a brush, in order to allow the water to flow when the device is applied to an object to be cleaned.

U.S. Pat. No. 3,453,059 issued to Molly L. Noble on Jul. 1, 1969 discloses a Bathtub Spraymop including a flaccid, moplike portion which is permanently attached to a disc portion which includes a plurality of water spray outlet holes. The surrounding moplike portion must provide for the ready flow of water therethrough since the water outlets provided by the disc are contained within the moplike portion.

U.S. Pat. No. 3,498,546 issued to John F. Logan et al. on Mar. 3, 1970 discloses a Sink Spray which provides for the adjustability of the spray or flow. However, no mechanical scrubbing means is included.

U.S. Pat. No. 3,743,188 issued to Josef Wagner on Jul. 3, 1973 discloses a Spray Gun. As the device is intended for use in spraying paint, no mechanical scrubbing attachment is disclosed.

U.S. Pat. No. 4,126,401 issued to Donald A. Stoyshin on Nov. 21, 1978 discloses a Combination Sudser And Rinser Brush. The brush is an integral component of the device, rather than being later installable as in the case of the present invention.

U.S. Pat. No. 4,311,404 issued to Masao Kodera on Jan. 19, 1982 discloses a Sprinkler Brush Assembly wherein the brush component is again permanently affixed to the remainder of the device, unlike the present invention.

U.S. Pat. No. 4,761,839 issued to Richard M. Ganaway on Aug. 9, 1988 discloses a Sink Spray And Auxiliary Attachment Device. A detachable brush portion is disclosed, but the brush portion completely surrounds the water outlet or nozzle. Moreover, the nozzle portion must be specially formed to provide for the attachment of the specifically cooperating brush portion, unlike the present invention.

Finally, U.S. Pat. No. 5,070,552 issued to Jefferson L. Gentry on Dec. 10, 1991 discloses a Personalized Hand Held Shower Head including a sponge captured and disposed over the outlet or nozzle portion. The sponge somewhat limits the outflow of water from the nozzle portion, unlike the present invention.

None of the above noted patents, taken either singly or in combination, are seen to disclose the specific arrangement of concepts disclosed by the present invention.

SUMMARY OF THE INVENTION

By the present invention, an improved scrubbing attachment for spray nozzles is disclosed.

Accordingly, one of the objects of the present invention is to provide an improved scrubbing attachment which may be easily and simply attached to a wide variety of existing sprayers.

Another of the objects of the present invention is to provide an improved scrubbing attachment which is secured non-concentrically to such an existing spray nozzle.

Yet another of the objects of the present invention is to provide an improved scrubbing attachment which allows relatively unimpeded flow through the nozzle and past the scrubbing means.

Still another of the objects of the present invention is to provide an improved scrubbing attachment which is radially offset from the axis of flow of the existing spray nozzle or spray head.

A further object of the present invention is to provide an improved scrubbing attachment which includes mechanical scrubbing means which is relatively dense and non-porous, to achieve a more efficient scrubbing action.

An additional object of the present invention is to provide an improved scrubbing attachment which is relatively inexpensive to manufacture and purchase.

A final object of the present invention is to provide an improved scrubbing attachment which may be provided in combination with a spray nozzle or spray head, thus providing the benefits of both devices in a single unit.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
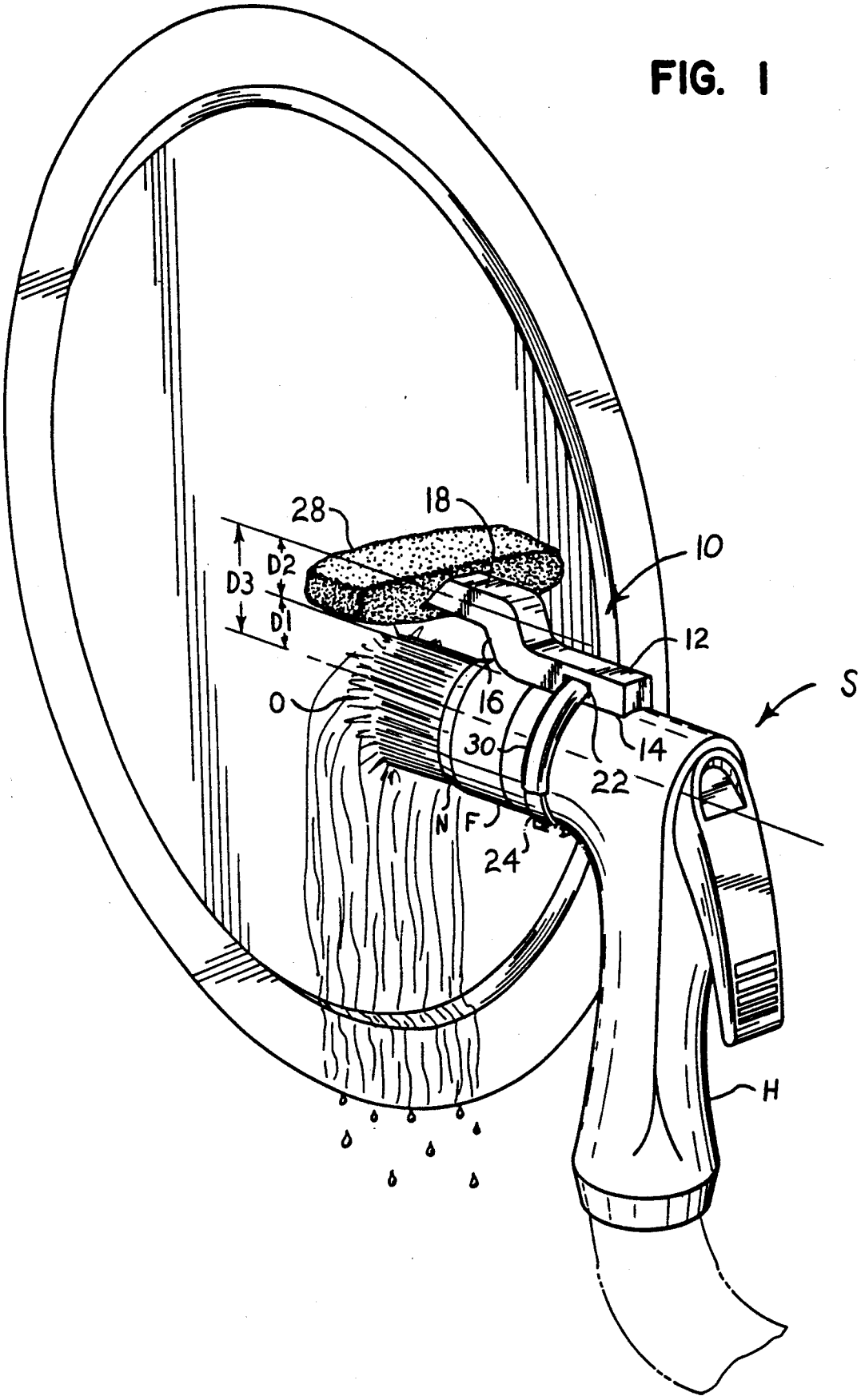
FIG. 1 is a perspective view of the present invention as it would be installed upon an existing spray head or nozzle and showing its use in scrubbing dishes or like utensils during the washing thereof.

Referring now particularly to FIG. 1 of the drawings, the present invention will be seen to relate to a sprayer nozzle attachment 10 which may be secured to an existing spray nozzle or spray head S in order to provide for mechanical scrubbing in addition to the flow or spray provided by the spray nozzle S. Attachment 10 includes an arm 12, which arm 12 is provided with a sprayer nozzle attachment portion 14, an intermediate offset portion 16, and scrubber attachment portion 18. The scrubber attachment portion 18 terminates in a forwardly projecting distal end having a lateral scrubber securing member 20 extending perpendicularly thereacross (shown in FIG. 2), so that arm 12 has the appearance of a T when viewed from above. Arm 12 is preferably formed of a hard and durable plastic material as a single unit, but other suitable materials (e.g., aluminum, stainless steel) may be used as desired.

The nozzle or sprayer attachment portion 14 of arm 12 will be seen to contain a lateral passage 22 therethrough, which passage 22 provides for securing arm 12 to a spray nozzle S by means of a securing strap 24 (more clearly shown in FIG. 2), as will be described further below. In order to preclude any positional shifting of attachment 10 relative to a spray nozzle S to which it is attached, the attachment portion 14 of arm 12 will also be seen to have a linearly concave channel 26 which lies adjacent to and in contact with the surface of spray nozzle S when attachment 10 is secured thereto. As the typical spray nozzle S includes a generally rounded, convex outer surface, the channel 26 formed to cooperate with the outer surface of spray nozzle S serves to prevent the slippage of attachment 10 when attached thereto.

Figure 2:
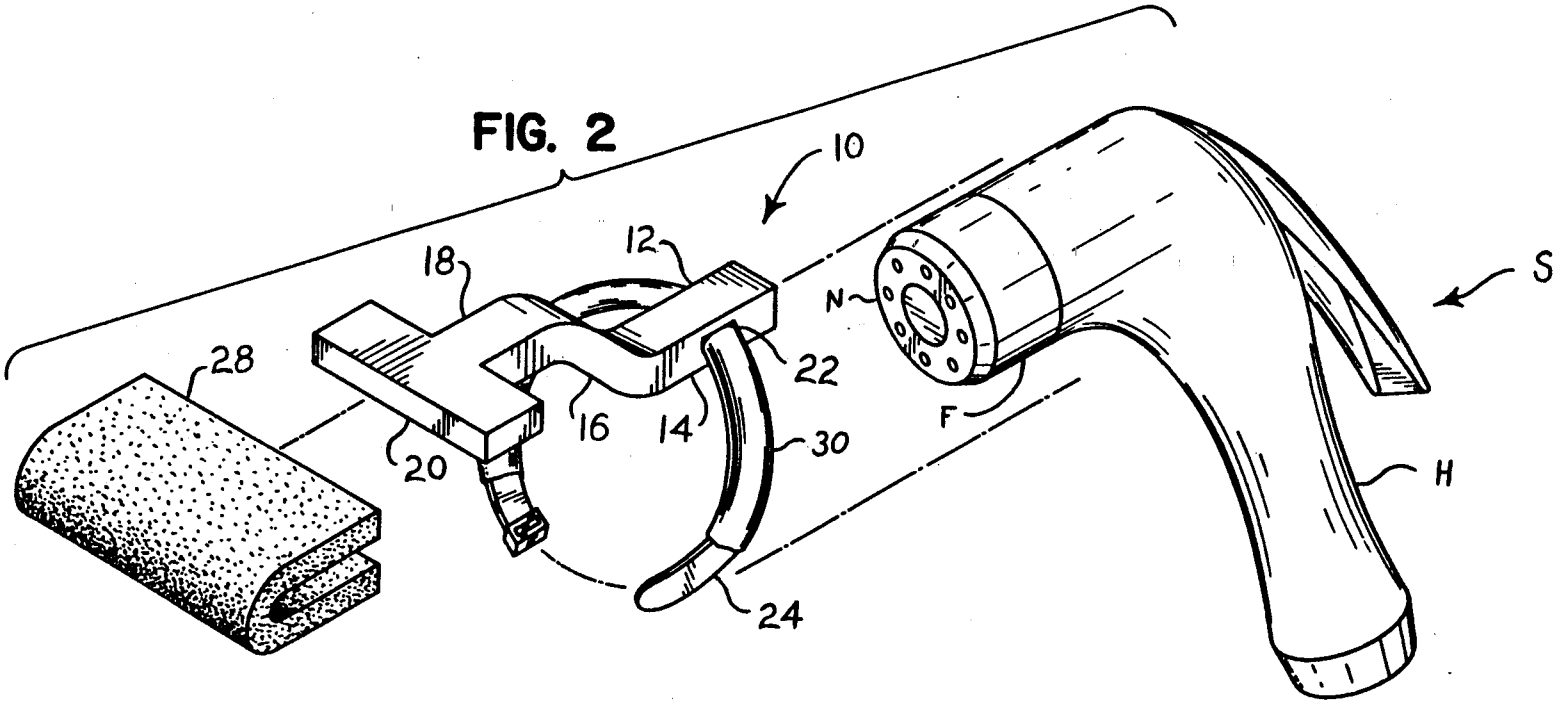
FIG. 2 is an exploded perspective view of the scrubbing device of the present invention, showing its components and installation on an existing spray nozzle.

A scrubbing pad 28 is affixed to and covers the lateral scrubber securing member 20 of arm 12. Scrubbing pad 28 is preferably formed of a relatively dense and firm, semi-porous material providing relatively good mechanical scrubbing action over the typical concentric brush and sponge devices used for cleaning; a material such as a Scotchbrite (tm) pad is suitable. Scrubbing pad 28 may be wrapped around the scrubber securing member 20, as shown in FIG. 2, and attached thereto by means of an adhesive, stitching around the perimeter, or other suitable means. Other mechanical cleaning means may be substituted for scrubbing pad 28 if desired, such as a squeegee, scraper or other device.

Scrubbing attachment 10 is secured to a spray nozzle S by means of securing strap 24 concentrically around the outflow portion F of sprayer S. Strap 24 may comprise a self-locking plastic tie, or alternatively a metal clamp or other suitable securing means may be used. To preclude the circumferential shifting of arm 12 around sprayer S, a friction sleeve 30 formed of heat shrink tubing, rubber or plastic tubing, or other suitable material is slipped over the strap 24 before inserting strap 24 (with friction sleeve 30) through passage 22 and installing attachment 10 on the spray head or nozzle S. When strap 24 is then tightened, the compression of friction sleeve 30 between the sprayer S, strap 24, and arm 12 will preclude the circumferential slippage of arm 12 around the spray head S. It will be seen that the force applied to scrubbing pad 28 will tend to displace attachment 10 axially along sprayer S when scrubbing action takes place. However, the angular relationship of the handle portion H to the outflow portion F of the typical sprayer S will prevent the rearward slippage of securing strap 24, and thus attachment 10, to maintain the relative position of the scrubbing pad 28 in front of and radially displaced from the nozzle end N of sprayer S.

Figure 3:
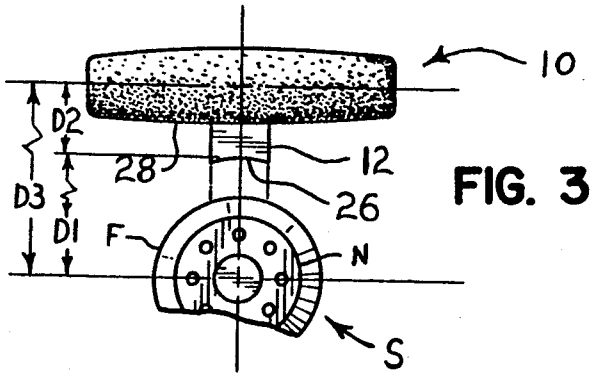
FIG. 3 is a front view of the present invention showing the cooperating shape of the surface which mates with a spray nozzle, in order to provide more secure attachment thereto.

A review of FIGS. 1 and 3 shows the offset relationship of scrubbing pad 28 relative to the outflow O and outflow portion F of sprayer S. The distance D1 from the center to the circumferential periphery of the outflow portion F of nozzle S, in addition to the offset distance D2 from the channel 26 to the center of the pad 28, results in a total offset distance D3 from the center of the outflow portion F of spray nozzle S to pad 28. (It will be seen that the distances D1 and D3 are exaggerated in FIG. 3 due to the exploded nature of the drawing.) This offset distance permits the unimpeded flow of water or fluid from the outflow portion F of spray head S, while simultaneously allowing vigorous scrubbing action to take place by means of the relatively firm and non-porous pad 28. This combination of unimpeded flow by means of the offset and non-concentric positioning of pad 28 relative to the outflow O of sprayer S, and the resulting ability to provide a relatively firm and mechanically effective pad 28, results in an ability to clean and remove burned on and stuck residue from dishes and other utensils, which was previously much more difficult to achieve.

It is to be understood that the present invention is not limited to the sole embodiment described above, but encompasses any and all embodiments within the scope of the following claims.

I claim:

1. A scrubbing attachment for a spray nozzle providing a concentric fluid flow, said scrubbing attachment comprising:

a scrubbing pad;

a single, monolithic arm including a nozzle attachment portion, a scrubber attachment portion, and an intermediate offset portion therebetween, said intermediate offset portion configured to displace said scrubbing pad from the spray nozzle concentric fluid flow;

said nozzle attachment portion including a nozzle contact side;

said scrubber attachment portion including a forwardly projecting distal end having a scrubber securing member extending therefrom;

said scrubbing pad secured to and substantially surrounding and covering said scrubber securing member;

a securing strap providing for the securing of said arm to a spray nozzle;

said nozzle attachment portion including lateral passage means providing for the lateral passage therethrough of said securing strap, whereby;

said securing strap is passed through said lateral passage of said nozzle attachment portion of said scrubbing attachment and tightened about the spray nozzle, with said nozzle contact side of said nozzle attachment porton immediately adjacent to and in contact with the spray nozzle, to secure said scrubbing attachment to the spray nozzle with said scrubbing pad radially offset from any concentric fluid flow issuing from the spray nozzle and projecting forward from the spray nozzle.

2. The scrubbing attachment of claim 1 wherein:

said scrubber securing member extends laterally from said distal end of said scrubber attachment portion.

3. The scrubbing attachment of claim 2 wherein:

said scrubber securing member is perpendicular to said scrubber attachment portion.

4. The scrubbing attachment of claim 1 including:

a friction sleeve surrounding said securing strap.

5. A scrubbing attachment for a spray nozzle, said scrubbing attachment comprising:

an arm including a nozzle attachment portion, a scrubber attachment portion, and an intermediate offset portion therebetween;

said nozzle attachment portion including a nozzle contact side and a linearly concave channel formed in said contact side;

said scrubber attachment portion including a forwardly projecting distal end having a scrubber securing member extending therefrom;

a scrubbing pad secured to said scrubber securing member;

a securing strap configured to secure said arm to a spray nozzle;

said nozzle attachment portion including lateral passage means providing for the lateral passage therethrough of said securing strap, whereby;

said securing strap is passed through said lateral passage of said nozzle attachment portion of said scrubbing attachment and tightened about the spray nozzle, with said nozzle contact side of said nozzle attachment portion immediately adjacent to and in contact with the spray nozzle, to secure said scrubbing attachment to the spray nozzle with said scrubbing pad radially offset and projecting forward from the spray nozzle.

6. The scrubbing attachment of claim 1 wherein:

at least said nozzle attachment portion, said scrubber attachment portion, and said intermediate offset portion are formed of plastic material.

7. The scrubbing attachment of claim 1 wherein:

said scrubbing pad is formed of a dense and firm semi-porous material.

8. The scrubbing attachment of claim 1 wherein:

said securing strap is formed of a self-locking plastic tie.

9. In combination with a spray nozzle providing a concentric fluid flow, a scrubbing attachment comprising:

a scrubbing pad;

a single, monolithic arm including a nozzle attachment portion, a scrubber attachment portion, and an intermediate offset portion therebetween, said intermediate offset portion configured to position said scrubbing pad offset from said spray nozzle concentric fluid flow;

said nozzle attachment portion including a nozzle contact side;

said scrubber attachment portion including a forwardly projecting distal end having a scrubber securing member extending therefrom;

said scrubbing pad secured to and substantially surrounding and covering said scrubber securing member;

a securing strap providing for the securing of said arm to a spray nozzle;

said nozzle attachment portion including lateral passage means providing for the lateral passage therethrough of said securing strap, whereby;

said securing strap is passed through said lateral passage of said nozzle attachment portion of said scrubbing attachment and tightened about said spray nozzle, with said nozzle contact side of said nozzle attachment portion immediately adjacent to and in contact with said spray nozzle, to secure said scrubbing attachment to said spray nozzle with said scrubbing pad radially offset from any concentric fluid flow issuing from said spray nozzle and projecting forward from said spray nozzle.

10. The scrubbing attachment of claim 9 wherein:

said scrubber securing member extends laterally from said distal end of said scrubber attachment portion.

11. The scrubbing attachment of claim 10 wherein:

said scrubber securing member is perpendicular to said scrubber attachment portion.

12. The scrubbing attachment of claim 9 including:

a friction sleeve surrounding said securing strap.

13. The scrubbing attachment of claim 9 wherein:

said nozzle attachment portion of said arm includes a linearly concave channel formed in said contact side.

14. The scrubbing attachment of claim 9 wherein:

at least said nozzle attachment portion, said scrubber attachment portion, and said intermediate offset portion are formed of plastic material.

15. The scrubbing attachment of claim 9 wherein:

said scrubbing pad is formed of a dense and firm semi-porous material.

16. The scrubbing attachment of claim 9 wherein:

said securing strap is formed of a self-locking plastic tie.

* * * * *